US006228442B1

(12) United States Patent
Coco

(10) Patent No.: US 6,228,442 B1
(45) Date of Patent: May 8, 2001

(54) ALL SEASON ORNAMENTAL LAMP-POST TREE

(76) Inventor: Keith Coco, 7 Stevens Ter., Merrimac, MA (US) 01860

( * ) Notice: Subject to any disclaimer, the term of this patent is extended or adjusted under 35 U.S.C. 154(b) by 0 days.

(21) Appl. No.: 09/114,547

(22) Filed: Jul. 13, 1998

(51) Int. Cl.[7] ..... A47G 33/08; F21S 8/00; F21S 10/00

(52) U.S. Cl. ..... 428/18; 362/123; 362/431

(58) Field of Search ..... 428/18; 362/123, 362/431; 211/196, 205

(56) References Cited

U.S. PATENT DOCUMENTS 2,453,695 * 11/1948 Belling ..... 36/123 X
3,603,780 * 9/1971 Lu ..... 362/123
4,516,193 * 5/1985 Murphy ..... 362/123
5,567,045 * 10/1996 Bucek ..... 362/363

FOREIGN PATENT DOCUMENTS

2172135 * 9/1986 (GB) .

* cited by examiner

*Primary Examiner*—Francis J. Lorin
(74) *Attorney, Agent, or Firm*—Frederick R. Cantor, Esq

(57) ABSTRACT

An imitation ornamental tree can be formed by clamping a split sleeve around an outdoor lamp post, and extending imitation tree branches outwardly from the sleeve. Each tree branch can incorporate multiple electrical lights and lead wiring for the lights. The sleeve can have built-in circuitry for connecting the lead wiring to the power supply for the outdoor lamp, such that the tree lights can be energized by the lamp power supply. The imitation ornamental tree transforms the conventional outdoor lamp into a lighted ornamental display during the Christmas season, or whenever it is desired to have an outdoor ornamental tree.

3 Claims, 3 Drawing Sheets

ALL SEASON ORNAMENTAL LAMP-POST TREE

BACKGROUND OF THE PRESENT INVENTION

SUMMARY OF THE PRESENT INVENTION

This invention relates to an imitation ornamental tree, and particularly to an imitation ornamental tree adapted to be mounted on an outdoor lamp post.

Various patents have issued on imitation Christmas tree constructions. Some representative constructions are shown in U.S. Pat. No. 2,125,907 issued to J. Frei, U.S. Pat. No. 2,214,046 issued to J. Doran, U.S. Pat. No. 5,409,745 issued to E. McGuire, and U.S. Pat. No. 3,085,774 issued to J. DiIenno.

Ornamental trees (e.g. Christmas trees) are usually displayed indoors, e.g. in the family living room. Additionally, it is a fairly common practice to install ornamental Christmas tree lights on bushes and trees located outdoors. Another practice is to run a string of ornamental Christmas tree lights along areas of the family residence, e.g. along the edge areas of the building roof.

The present invention relates to an imitation ornamental tree adapted for installation on (or around) an outdoor lamp post. The imitation ornamental tree is equipped with miniature electric lights, whereby the lamp-tree combination provides a lighted display especially useful during the Christmas season. The imitation tree can be removed from the lamp post after the Christmas season, so that the lamp post can serve its normal function. The imitation tree is designed so that it can be attached to a conventional outdoor lamp post without altering or disfiguring the post. When the imitation ornamental tree is detached from the post, the post can function in its usual fashion.

Although the ornamental imitation tree is designed for use as a Christmas tree, it can be used for other purposes and other occasions, e.g. as a celebration or memorial observation tree, e.g. on a person's birthday, during the Easter season, on the Fourth of July, during Thanksgiving, or on Halloween.

Further features of the invention will be apparent from the attached drawings and descriptions of an illustrative embodiment of the invention.

In summary, and in accordance with the above discussion, the foregoing objectives are achieved in the following embodiments.

1. An imitation ornamental tree comprising a sleeve adapted to encircle an outdoor lamp post, and plural branches radiating from said sleeve.

2. The imitation ornamental tree, as described in paragraph 1, and further comprising miniature electric lights supported on said branches.

3. The imitation ornamental tree, as described in paragraph 2, and further comprising an electric circuit means interconnecting said electric lights, said circuit means having an electrical plug adapted to connect said circuit means to the power supply for the lamp on said lamp post.

4. The imitation ornamental tree, as described in paragraph 3, wherein said sleeve has a longitudinal axis, and a seam extending parallel to said longitudinal axis.

5. The imitation ornamental tree, as described in paragraph 4, wherein said sleeve is formed of a flexible material, whereby said sleeve can be opened along said seam to enable said sleeve to be installed on an outdoor lamp post.

6. The imitation ornamental tree, as described in paragraph 1, and further comprising miniature electric lights supported on said branches; and each said branch comprising a hollow tube having light-support holes at spaced points therealong.

7. The imitation ornamental tree, as described in paragraph 1, and further comprising miniature electric lights supported on said branches; and further comprising an electric circuit means interconnecting said electric lights; each said branch comprising a hollow tube having light-support holes at spaced points therealong; each said light having a socket means positioned in one of said holes; and said electric circuit means comprising lead wiring extending within said hollow tubes.

8. The imitation ornamental tree, as described in paragraph 7, wherein said electric circuit means comprises printed circuit means incorporated into said sleeve.

9. An imitation ornamental tree, comprising a split sleeve adapted to encircle an outdoor lamp post, plural branches radiating from said sleeve, miniature electric lights supported on said branches, and an electric circuit means interconnecting said electric lights; and said circuit means having an electrical plug adapted to connect said circuit means to the electrical power supply for the lamp on said lamp post.

10. The imitation ornamental tree, as described in paragraph 9, wherein said circuit means is built into said sleeve and said branches.

11. The imitation ornamental tree, as described in paragraph 10, wherein said circuit means comprises printed circuit means incorporated into said sleeve and flexible lead wiring incorporated into said branches.

DESCRIPTION OF THE PREFERRED EMBODIMENTS OF THE PRESENT INVENTION

Figure 1:
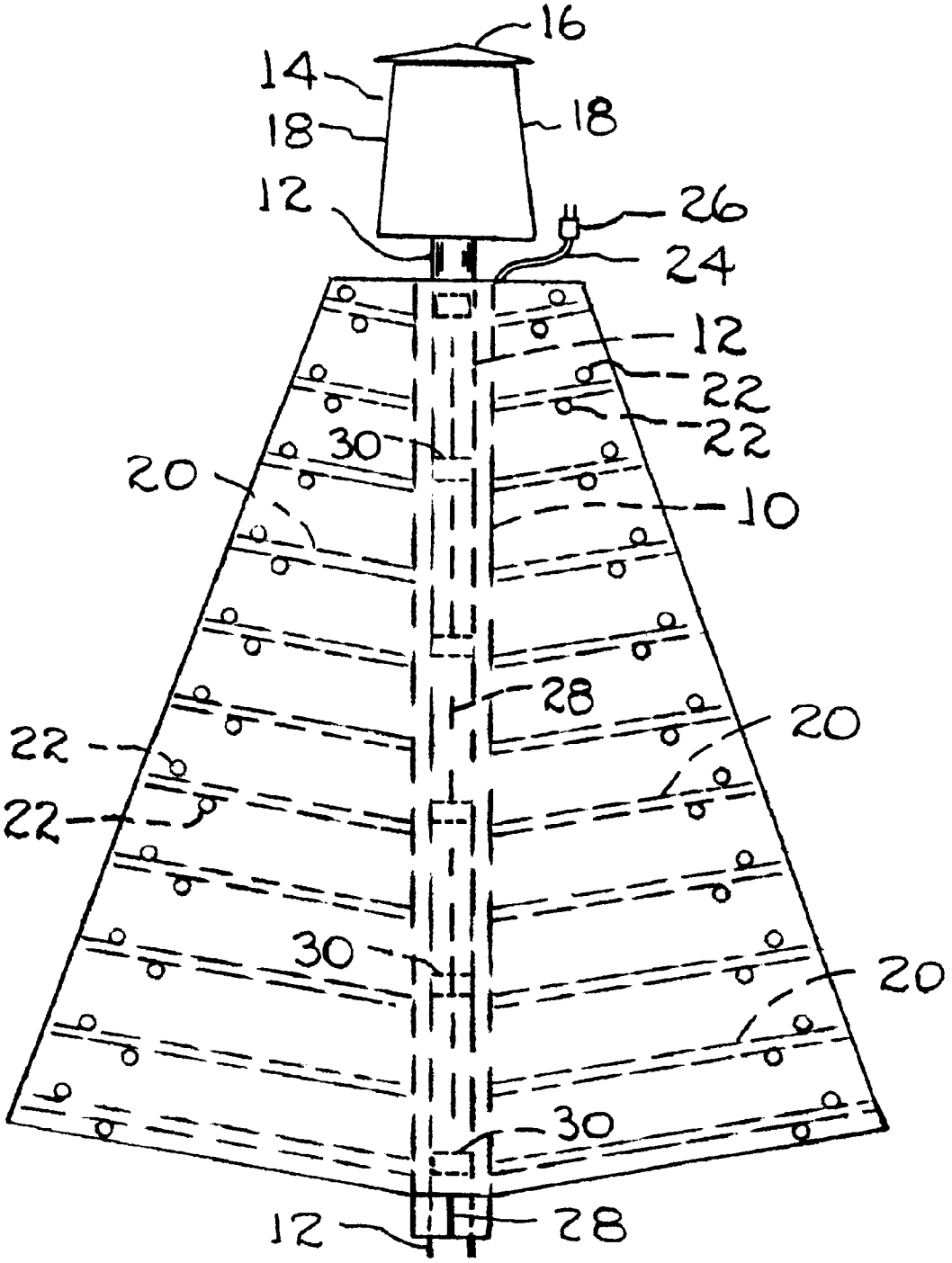
FIG. 1, is a side elevational view, of an imitation ornamental tree constructed according to the invention.

FIG. 1, is a side elevational view, of an imitation ornamental tree constructed according to the invention.

Referring to FIG. 1, there is shown an illustrative embodiment of an imitation ornamental tree constructed according to the invention. The illustrated imitation ornamental tree comprises an elongated sleeve 10 encircling a conventional lamp post 12 below a conventional lamp housing 14 that is attached to the upper end of the post.

Typically, lamp housing 14 will have a roof structure 16 and four sides 18 that are transparent or translucent, whereby light rays are enabled to radiate outwardly from an electric light located within housing 14. Post 12 is usually a hollow tubular structure having a lower portion located below ground level, such that the post is prevented from toppling or tipping in spite of adverse weather conditions. Wiring for the light bulb in lamp housing 14 usually goes underground and upwardly through the hollow lamp post 12. The light in lamp housing 14 can be turned on or off by means of a wall switch located in the associated residence.

The ornamental tree of the present invention comprises the aforementioned sleeve 10, together with a number of imitation tree branches 20 radiating outwardly from sleeve 10. As shown in FIG. 1, branches 20 are of decreasing length, from the bottom of the tree to the top of the tree. The imitation tree has a frusto-conical configurational appearance that resembles the conventional live Christmas trees that are often displayed indoors during the Christmas season.

The illuminated housing 14 is located at the apex of the imitation ornamental tree to serve as the uppermost illumination feature of the tree. Each tree branch 20 has two or more miniature electric lights 22 thereon, whereby the tree is fully illuminated. Electric power for lights 22 is preferably obtained from the electric power supply for the light in lamp housing 14.

As shown in FIG. 1, an electrical cord 24 having a male electrical plug 26 extends upwardly from sleeve 10 of the ornamental tree. After the imitation tree has been installed on lamp post 12, an electrical socket having a female electrical outlet is screwed onto the light socket in housing 14, after which electrical plug 26 is plugged into the electrical outlet. The electrical cord 24 forms part of an electric circuit that electrically interconnects the various miniature electric lights 22. Therefore, when plug 26 is plugged into the electrical outlet in lamp housing 14 the miniature lights 22 become electrically connected to the household electric supply. Lights 22 can be energized by means of the interior wall switch that is used to control the light in lamp housing 14.

Figure 2:
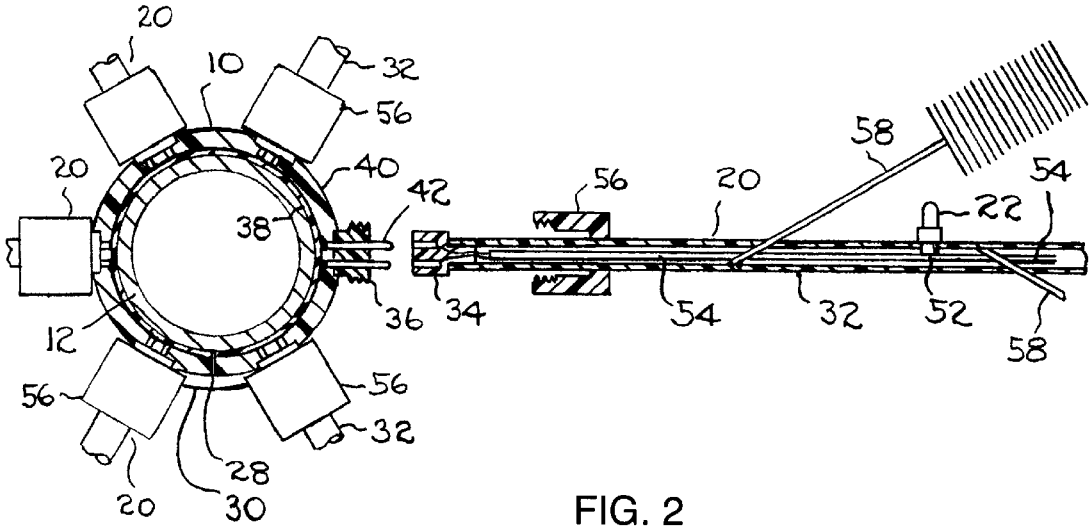
FIG. 2, is a fragmentary sectional view, taken along a horizontal plane through the ornamental tree of FIG. 1, showing structural features not apparent in FIG. 1.

FIG. 2, is a fragmentary sectional view, taken along a horizontal plane through the ornamental tree of FIG. 1, showing structural features not apparent in FIG. 1.

The imitation ornamental tree depicted in FIG. 1 has eleven rows of branches 20, located at spaced points along sleeve 10. Each row of branches contains six branches, constructed as shown in FIG. 2. The imitation ornamental tree thus has a total of sixty-six branches. Assuming that each branch has three miniature electric lights 22, the tree has a total of one hundred ninety-eight miniature lights. The invention can be practiced with a varying number of branches and miniature lights. Typically the sleeve 10 will have a length of about six feet (limited by the height of the associated lamp post 12). The rows of branches can be evenly spaced along the length of sleeve 10.

Sleeve 10 is preferably a split sleeve formed of a plastic material into a tubular configuration that fits snugly on the associated lamp post 12. The longitudinal split (or seam) 28 in the sleeve enables the sleeve wall areas bordering the split to be opened or spread apart, in order to permit the sleeve to be installed on lamp post 12. The sleeve is usually installed on the lamp post, prior to the step of connecting the tree branches 20 to the sleeve.

With sleeve 10 detached from tree branches 20, the elongated split sleeve is fitted around (onto) lamp post 12, after which suitable connectors are extended across seam 28 at spaced points along the sleeve length to firmly secure the sleeve to post 12. Various types of connectors can be used. For example, conventional hose clamps, of a suitable size, can be trained around the sleeve, at spaced points along the sleeve length. Also, it is possible to provide hook-and-loop fasteners at spaced points along the sleeve to clamp the sleeve to post 12.

As shown in FIG. 1, six hook-and-loop fasteners 30 are provided on sleeve 10 so as to span the seam 28. Each fastener 30 comprises a strip of fastener material attached to the sleeve on one side of the seam and a mating patch of fastener material attached to the sleeve on the other side of seam 28. The hook-and-loop fastener materials can be similar to materials marketed under the tradename VELCRO.

As shown in FIG. 2, a representative branch 20 comprises a hollow tube 32 having a female electrical connector 34 at its inner end adapted to mate with a male electrical connector 36 adhesively attached to sleeve 10. Sleeve 10 is a laminated split sleeve having an inner plastic layer 38 fitting around lamp post 12 and an outer plastic layer 40 laminated to inner layer 38. Each male electrical connector 36 has two electrical prongs 42 that electrically connect with conductive strips printed onto plastic layer 38. The conductive strips in turn connect with the aforementioned electrical cord 24 (FIG. 1), whereby the conductive strips are electrified (via the aforementioned electrical outlet in lamp housing 14).

Figure 3:
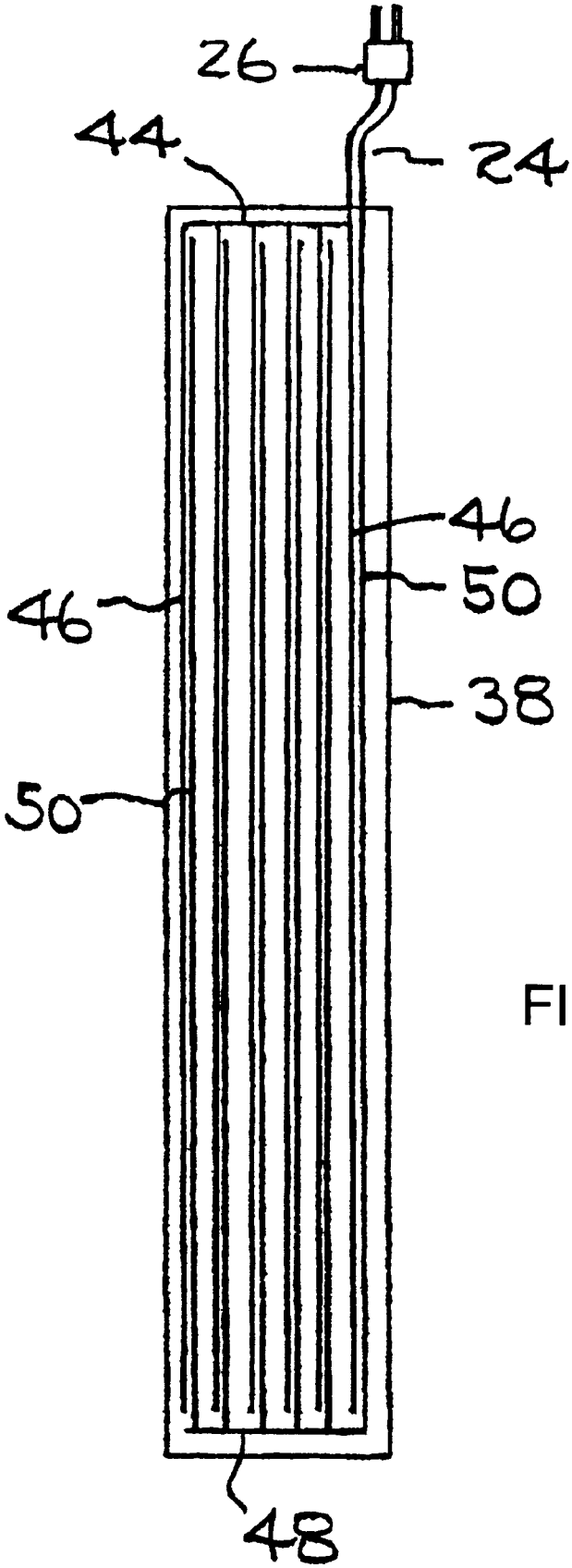
FIG. 3, is a view, of a component used in the FIG. 1 ornamental tree.

FIG. 3, is a view, of a component used in the FIG. 1 ornamental tree.

FIG. 3 shows one way in which the printed circuitry on plastic layer 38 can be connected to cord 24. The printed circuit comprises an upper conductive strip 44 connected to six conductive strips 46 running longitudinally along the surface of plastic layer 38, and a lower conductive strip 48 connected to six conductive strips 50 running alongside strips 46. One prong 42 in each male connector 36 connects to a strip 46, whereas the other prong connects to an associated strip 50. The prongs in each male connector 36 are thus of opposite electrical potential.

Each hollow tube 32 has two or three holes spaced therealong for mounting a conventional miniature electric light 22. As shown in FIG. 2, the socket portion 52 of a representative light fits into an associated hole in tube 32; a suitable adhesive can be used to secure the light in place. Similar lights can be positioned on the non-illustrated portion of tube 32 (to the right of light 22). Lead wiring 54 runs along the interior of tube 32 to connect the various lights to the electrical terminals in female connector 34. An electrical circuit is established when connector 34 is plugged onto mating connector 36. As previously noted, lamp 22 energization can be controlled from within the residence by a suitable wall switch.

Each hollow tube 32 is equipped with a threaded collar 56 that can be manually threaded onto the associated connector 36, whereby the hollow tube 32 is firmly attached to split sleeve 40. Each hollow tube 32 can be used to support a number of tree foliage rods (or heavy wires) 58 extend at acute angles to tube 32, as shown generally in FIG. 2.

By way of summarization, there is shown an imitation ornamental tree that includes a split sleeve 10 adapted to be releasably clamped to a conventional lamp post 12, said sleeve being adapted to support multiple tree branches 20 containing miniature electric lights 22. An electric circuit is incorporated into sleeve 10 and branches 20, whereby lights 22 can be connected to the lamp power supply by plugging the male connector 26 into an outlet located within lamp housing 14. The electrical power circuit for lights 22 includes flexible lead wiring 54 running within each hollow tube 32, and printed circuitry incorporated into split sleeve 10 (i.e. on the surface of sleeve layer 38). The various tree branches 20 (tubes 32) are detachably connected to sleeve 10 for compact storage purposes.

The ornamental imitation tree can be used on various occasions, e.g. during the Christmas season, at Easter, on a person's birthday, on the Fourth of July, at Halloween, or at Thanksgiving.

The present invention, described above, relates to an all season ornamental lamp post tree. Features of the present invention are recited in the appended claims. The drawings contained herein necessarily depict structural features and embodiments of the all season ornamental lamp post tree, useful in the practice of the present invention.

However, it will be appreciated by those skilled in the arts pertaining thereto, that the present invention can be practiced in various alternate forms, proportions, and configurations. Further, the previous detailed description of the preferred embodiments of the present invention are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. An imitation ornamental tree, comprising a split sleeve adapted to encircle an outdoor lamp post, plural branches radiating from said sleeve, miniature electric lights supported on said branches, and an electric circuit means interconnecting said electric lights; and said circuit means having an electrical plug adapted to connect said circuit means to the electrical power supply for the lamp on said lamp post.

2. The imitation ornamental tree, as described in claim 1, wherein said circuit means is built into said sleeve and said branches.

3. The imitation ornamental tree, as described in claim 2, wherein said circuit means comprises printed circuit means incorporated into said sleeve and flexible lead wiring incorporated into said branches.

* * * * *